US005127939A

United States Patent [19]

Panigrahy et al.

[11] Patent Number: 5,127,939

[45] Date of Patent: Jul. 7, 1992

[54] SYNTHETIC OLIVINE IN THE PRODUCTION OF IRON ORE SINTER

[75] Inventors: Sarat C. Panigrahy, LaPrairie; Michel G. Rigaud, Mont Royal; Pierre Legast, Sherbrooke, all of Canada

[73] Assignee: Ceram SNA Inc., Sherbrooke, Canada

[21] Appl. No.: 612,471

[22] Filed: Nov. 14, 1990

[51] Int. Cl.[5] ..... C21B 5/04

[52] U.S. Cl. ..... 75/323; 75/470; 75/472

[58] Field of Search ..... 75/323, 472, 470

[56] References Cited

U.S. PATENT DOCUMENTS

| | | | |
|---|---|---|---|
| 4,234,380 | 11/1980 | Kihlstedt et al. | 423/326 |
| 4,518,428 | 5/1985 | Ellenbaum et al. . | |
| 4,519,811 | 5/1985 | Lalancette et al. | 51/309 |
| 4,604,140 | 8/1986 | Lalancette et al. | 106/38.9 |
| 4,657,584 | 4/1987 | Bogdan et al. . | |
| 4,985,164 | 1/1991 | Delvaux et al. | 252/62 |

FOREIGN PATENT DOCUMENTS

| | | | |
|---|---|---|---|
| 00628 | 1/1990 | European Pat. Off. | 75/323 |

*Primary Examiner*—Melvyn J. Andrews
*Attorney, Agent, or Firm*—Foley & Lardner

[57] ABSTRACT

An improved iron ore sinter for use in a blast furnace is made from a raw sinter mix comprising: iron-bearing materials; basic fluxes including a source of CaO and a source of MgO; and solid carbon-bearing material usually coke breeze, used as a heat-generating combustible. To produce the sinter, the raw sinter mix is subjected to a sintering treatment at a high temperature in order to cause the iron-bearing materials, fluxes and carbon-bearing material to agglomerate and sinter by incipient fusion; an air-cooling treatment in order to produce a hard lumpy substance having a porous cellular structure; and a mechanical treatment to break the lumpy substance into a specific size range. The improvement to the above sinter lies in that the source of MgO in the raw sinter mix exclusively consists of synthetic olivine obtained by calcination of serpentinite. Such a use of synthetic olivine has numerous and unexpected advantages over the use of natural olivine as a source of MgO in the manufacture of iron ore sinter for blast furnace, especially in terms of enhanced sinter strength, improved sinter reduction properties and productivity.

12 Claims, No Drawings

SYNTHETIC OLIVINE IN THE PRODUCTION OF IRON ORE SINTER

BACKGROUND OF THE INVENTION a) Field of the Invention

The present invention relates to an improved iron ore sinter for use in a blast furnace. More particularly, it relates to an improved iron ore sinter wherein the improvement consists in using synthetic olivine in place of natural olivine or dolomite as a source of MgO.

b) Brief Description of the Prior Art

As is well known in the art of metallurgy, four basic ingredients have to be fed into a blast furnace to produce iron by chemical reduction of iron oxides and/or other iron-bearing substances, namely:

a) the iron oxides and/or iron-bearing substances per se, in the form of sinters, pellets, briquettes or any other type of agglomerates, or occasionally lumpy raw ores;

b) basic fluxes including a source of CaO and a source of MgO selected amongst for example, limestone, dolomite, natural olivine and the like, whose purpose is to form a slag by reaction with the acid gangue constituents of the feed;

c) metallurgical coke used as a heat-generating combustible and as a reducing agent when it is transformed into carbon monoxide by controlled combustion with air; and d) air to provide oxygen and thus support the combustion and slag formation.

All of these basic ingredients may be fed into the blast furnace one at a time, in predetermined amounts, to form successive layers of iron oxides, fluxes and coke through which air is blown. As the coke burns, the iron oxides or other iron-bearing substances melt and are reduced to form the desired iron in molten form. The impurities are "collected" in the liquid slag formed by the fluxes and can be separated from the iron and removed from the furnace.

In recent years, it has been suggested to combine all of these ingredients together in the form of agglomerates, especially pellets or sinters, in order to improve the permeability of the charge and thus permit higher gas flow and better gas-solid contact within the furnace. In this connection, reference can be made, by way of example, to U.S. Pat. No. 4,518,428 issued in 1985 to International Minerals & Chemical Corp., or U.S. Pat. No. 4,657,584 issued in 1987 to U.S. Steel Corp.

The main advantage of using pellets or sinters in which all the basic ingredients are combined (except air) is that such a use substantially reduces, not to say eliminates the introduction of basic fluxes in raw form into the furnace. As a result:

1) substantial savings are obtained in the consumption of expensive metallurgical coke, which would otherwise be required to calcine the raw fluxes, and 2) blast furnace productivity (expressed in tons/$m^2$ of hearth area) is increased by as much as 50%.

As already indicated hereinabove, the fluxes used in the blast furnace must include a source of CaO and a source of MgO. In operation, both of these oxides react with the acid gangue usually found in the iron-bearing substances used as an iron source, which gangue includes $SiO_2$, $Al_2O_3$ and other impurities such as sulphur and phosphorous, the product of this reaction being the slag.

In practice, the formation of a slag of proper chemistry and fluidity is of a great importance to activate smooth operation of the blast furnace. Indeed, the volume and chemistry of the slag whose purpose is to carry the unwanted impurities and help in the separation of iron in the hearth of the furnace and subsequent removal of this iron from the furnace are both known to influence the thermal balance and the partition of sulphur between the slag and the molten iron.

The major chemical constituents and composition of the slags of most of the existing blast furnaces presently in operation, are as follows:

TABLE I

| % CaO | % MgO | % $Al_2O_3$ | % $SiO_2$ |
|---|---|---|---|
| 34–47 | 4–12 | 10–22 | 31–39 |

As can be seen, MgO is an important ingredient of the slag.

In practice, when use is made of iron ore sinters, the MgO found in the slag comes from the sinter into which the basic fluxes are incorporated. Wherever necessary, but to a lesser extent, additional MgO may be introduced in the form of fluxed pellets or through direct addition of dolomite, natural olivine (see U.S. Pat. No. 4,518,428), periclase (see U.S. Pat. No. 4,657,584) or similar material.

As already indicated thereinabove, the practice of adding an MgO-containing material directly into the blast furnace has largely been discontinued because of economic and metallurgical considerations. Therefore, the iron-bearing agglomerates that are presently used in the form of sinters and pellets invariably contain certain amounts of MgO, which usually vary between 1 and 3% by weight and in special cases, up to 10%.

The incorporation of MgO directly into the agglomerates (sinters or pellets) has many advantages, some of which are:

improved resistance to low-temperature degradation, leading to a decrease in flue dust losses;

improved high-temperature reduction characteristics, maintaining the structure of agglomerates for good reduction;

reduction in the range of softening and meltdown temperature and increase in the respective temperatures;

reduction of hanging and scaffolding;

good desulphurizing properties and strong affinity for sulphur;

minimization of Fe loss in the slag; and for high aluminous blast furnace slags, increase in the slag fluidity.

In essence, the incorporation of MgO in agglomerates such as sinters or pellets, leads to smooth and economic blast furnace operation and improved hot metal quality.

Presently, the MgO incorporated into the agglomerates comes from dolomite, natural olivine, dunite, burnt dolomite etc. The use of such "natural" materials as sources of MgO is dictated primarily by cost, quality, and proximity to the source, despite the fact that the quality of sinter may substantially vary depending on the source of the MgO-containing material. It has been found however in many European and Australian steel plants, that the use of natural olivine as a source of MgO is better than the use of any other material from the standpoint of productivity and as well as quality of the agglomerates. The use of natural olivine is suggested in U.S. Pat. No. 4,518,428 but is rather limited in North America because of its non-availability and high importation cost, although it is admitted that the addition of natural olivine to the blast furnace increases the MgO content of the slag and the fluidity range of the slag, and makes it less sensitive to other chemical impurities or to temperature variation.

On the other hand, it is also known that the viscosity of the slag is dependent on the basicity ratio. The basicity ratio of the sinter, $(CaO+MgO)$ to $(SiO_2+Al_2O_3)$, should remain preferably between 1.5 and 2.6. Since olivine is a mineral of general formula $Mg_2SiO_4$, one can see that the addition of olivine as a source of MgO in a blast furnace is particularly interesting since, with such a mineral, $SiO_2$ is added at the same rate as MgO in the furnace, thereby leaving the basicity ratio substantially unaffected.

In practice, olivine added to the blast furnace as a "trim", is of the same size as the other raw materials, i.e. 10–50 mm with less than 10% of the particles below 10 mm. A good lump size is important in the blast furnace where permeability must be maintained in order to prevent poor gas flow and the build up of back pressure. In turn, good permeability is advantageous to ensure a continuous blast of gas which results in an efficient furnace operation with the attendant reduction in coke rate (volume of coke required per ton of hot metal being produced).

Dolomite, extensively used in the past as a source of MgO, is steadily decreasing in popularity because, on the one hand, it requires the addition of silica to maintain the basicity ratio of the slag and, on the other hand, it must be calcined prior to being used.

Therefore, the use of lump olivine as a trim represents a less costly single step procedure, provided that the mineral is readily available.

SUMMARY OF THE INVENTION

The present invention is based on the discovery that the use of synthetic olivine obtained by calcination of serpentinite, has numerous and unexpected advantages over the use of natural olivine as a source of MgO in the manufacture of iron ore sinter for blast furnace, especially in terms of enhanced sinter strength, improved sinter reduction properties and productivity.

Therefore, the invention provides an improved iron ore sinter for use in a blast furnace, said sinter being made from a raw sinter mix comprising:

- iron-bearing materials;
- basic fluxes including a source of CaO and a source of MgO; and
- solid-carbon bearing materials, usually coke breeze, used as a heat-generating combustible and reducing agent, the raw sinter mix being subjected to:
- a sintering treatment at a high temperature in order to cause the iron-bearing materials, fluxes and carbon-bearing materials to agglomerate and sinter by incipient fusion;
- an air-cooling treatment in order to produce a hard lumpy substance having a porous cellular structure; and
- a mechanical treatment to break the lumpy substance into a specific size range.

In accordance with the invention, the improvement to the above sinter lies in that the source of MgO in the raw sinter mix consists of synthetic olivine, exclusively.

The improved iron-ore sinter that is so obtained may be used as feed material in an iron reduction process. It is however mainly intended to be used as a iron-bearing material for use in a blast furnace for the production of iron.

In addition to obtaining a sinter meeting all the usually required quality criteria, the use of synthetic olivine as a source of MgO improves the sinter strength and its reduction properties, especially when compared with dolimite which is presently the most conventional material used for the production of sinter. Improvement in sinter productivity is also noted.

Preferably, the raw sinter mix is selected so that the resulting iron-ore sinter has the following chemical composition:

| | |
|---|---|
| Fe | from 48 to 60% |
| CaO | from 7 to 15% |
| $SiO_2$ | from 3 to 8% |
| MgO | from 1 to 5% |
| $Al_2O_3$ | from 0.3 to 3% |

the percentage being expressed by weight and the balance consisting of FeO, Mn, S and moisture, with the provision that the basicity ratio of this composition, defined as:

$$\frac{CaO + MgO}{SiO_2 + Al_2O_3}$$

be ranging between 1.5 and 2.6.

Preferably also, the iron-bearing materials comprise up to 50% by weight of fine iron ore concentrates and the source of CaO in the raw sinter mix is limestone.

As usual, the carbon-bearing material may be selected from the group consisting of coke breeze, petroleum coke, coal or mixture thereof.

GENERAL DESCRIPTION OF THE INVENTION

A—Synthetic Olivine

As indicated thereinabove, the iron-ore sinter according to the invention comprises synthetic olivine as source of MgO.

Synthetic olivine may be in granular or fiber-like form depending on the kind of material used as starting material for its production.

Whatever be its structure, synthetic olivine is a derivative of serpentinite which is found in nature under two different forms, namely a granular form and a fibrous form which is called chrysotile, or asbestos fibre. Both these minerals are monoclinic and have roughly the same chemical composition but different crystallographic forms (grains or fibers). They both crystallize in synthetic olivine when they are subjected to high temperatures (greater than 700° C.).

Olivine as such, is a group of minerals ranging between two extremes, namely magnesium olivine called forsterite, of formula $Mg_2SiO_4$, and a ferrous olivine called fayalite, of formula $Fe_2SiO_4$, which crystallize in the orthorhombic system. Between these two extremes, there are other minerals containing both Fe and Mg in various amounts, which are also called olivine. Typically, such intermediate minerals may be of formula $(MgFe)_2SiO_4$.

Granular Synthetic Olivine

Granular synthetic olivine can be obtained by calcination of serpentinite rocks rejected as tailings in the asbestos mines.

When heated at a high temperature (greater than 750° C.), the crushed serpentinite mineral looses all its water and recrystallizes in forsterite, which occurs in orthorhombic crystallographic form. The presence of minor amounts of magnetite or hematite in the serpentinite causes the formation of ferric forsterite, which, as aforesaid, is also called olivine. If the temperature is increased above 1,000° C., another magnesium mineral called enstatite ($MgSiO_3$) appears in the olivine mix.

In practice, granular synthetic olivine is usually made at high temperatures (1,250° to 1,350° C.) and the chemical transformation that occurs during calcination can be schematically represented as follows:

$$\underset{\text{(serpentinite)}}{3.MgO.2SiO_2 2H_2O} + \text{heat/time} \longrightarrow \underset{\text{(enstatite)}}{MgSio_3} + \underset{\text{(forsterite)}}{Mg_2SiO_4} + 2H_2O$$

Depending on the chemical composition of the starting material being used, the chemical composition of the granular synthetic olivine which is obtained is as follows (the percentages being expressed by weight):

| | |
|---|---|
| MgO | 45–48% |
| $SiO_2$ | 42–45% |
| $Fe_2O_3$ | 7–10% |
| $Al_2O_3$ | 1–2% |
| CaO and other | <1% |

As can be seen, this synthetic material has a high MgO concentration. It also contains iron and has substantially the same physical aspect as sand, with a bulk density of 90–110 lbs/pi$^3$.

To date, granular synthetic olivine has been used as foundry sand (see U.S. Pat. No. 4,604,140 issued in 1986 to Société Nationale de l'Amiante), sandblasting agent (see U.S. Pat. No. 4,519,811 issued in 1985 to Société Nationale de l'Amiante) or refractory sand. To the Applicant's knowledge, it has never been suggested to use this material as a source of MgO in the production of sinter for blast furnaces, although it is known that it contains a high MgO concentration and that large quantities of crushed and finely ground serpentinite are available for use as initial raw material.

Fibrous-Like Synthetic Forsterite

This other type of synthetic olivine is obtained by calcination of chrysotile asbestos fibers at a temperature of from 650° C. to 1,450° C. This synthetic material has an $MgO:SiO_2$ ratio lower than 1.1, a raw loose density of from 3 to 40 pcf, a thermal conductivity "k" factor of from 0.25 to 0.40 BTU. in/hr. °F.ft$^2$ and a fusion point of from 1,600° to 1,700° C. It is obtained in a fibrous like form and maintains this form even when it is processed.

Fibrous-like synthetic forsterite, hereinafter called FRITMAG (trademark) is disclosed in U.S. patent application Ser. No. 07/246,198 filed on Sep. 16, 1988 in the name of the Applicant. Its chemical composition is as follows (the percentages being expressed by weight):

| | |
|---|---|
| MgO | 47% |
| $SiO_2$ | 47% |
| $Fe_2O_3$ | 3.0% |
| $Al_2O_3$ | 1.0% |

-continued

| | |
|---|---|
| CaO and other | 2.0% |

As can be seen, FRITMAG also has a high MgO concentration.

To date, it has been suggested to use FRITMAG for the manufacture of insulation products, fibrous cement composition or brake linings, or in some vacuum forming processes. To the Applicant's knowledge, it has never been suggested so far to use FRITMAG as a source of MgO in the production of sinter for blast furnaces, although it has a high MgO content.

B—Sinter Versus Pellets for Use in Blast Furnaces

Sinter Production

As explained hereinabove, the primary iron-bearing materials used for the production of iron in a blast furnace are iron ore agglomerates in the form of sinter or pellets. On a world-wide basis, sinters are preferred over pellets approximately in the proportion of 65:35, because of the main advantages of the sintering process in terms of cost-effectiveness and ability to utilize a majority of the recyclable materials produced in steel plants, which is quite desirable from an environmental point of view.

The sintering process basically consists in converting iron-containing materials of fine particle size (0.1–10 mm) into coarse agglomerates by incipient fusion of the ore particles at their contact surfaces, due to the combustion of premixed solid fuel.

In the steel industry, the iron-bearing materials used for the production of sinter, usually consist of iron ore fines and/or concentrates and revert materials such as mill scale, flue dust, processed iron fines from iron and steelmaking operations, sinter returns, sinter and pellets screenings and other recovered waste materials containing different amounts of iron.

The basic fluxes necessary to the operation of the blast furnace are incorporated advantageously into the sinter. As was already explained in the preamble of the present disclosure, the incorporation of the basic fluxes in the sinter mix is a very cost-efficient method inasmuch as it saves a substantial amount of expensive metallurgical coke. The basic fluxes contain MgO and CaO which react with the acid constituents of iron ore fines and concentrates, coke ash, etc. and act as slag formers. The source of CaO in the fluxes may be crushed limestone or dolomite. Sometimes, acid components such as quartz, alumina-bearing materials may also be deliberately added to the sinter mix so that when the sinter is charged in the blast furnace, the resulting blast furnace slag that is formed has some desired properties or compositions.

The solid carbon-bearing material that is incorporated into the sinter mixture is intended to be used as a fuel and may consist of coke breeze, petroleum coke, coal or other carbonaceous material capable of causing incipient fusion of the ore particles by combustion.

The aforesaid materials i.e. the iron-bearing materials, basic fluxes and carbon-bearing material are mixed usually with 4–6.5% moisture to cause the particles to adhere to each other and forms a raw sinter mix that may be subjected to micropelletization in known devices such as rotary drums or disks.

A suitably micropelletized feed will provide good bed permeability during sintering and will result in an increased sintering rate.

The sintering is usually carried out in a DWIGHT-LLOYD-type continuous travelling grate machine.

The coke breeze on the top of the bed is subjected to combustion by burning oil or natural gas through burners in the ignition hood of the machine. Combustion is maintained by continuous suction of air through the charge from below. Burning of the coke breeze causes incipient fusion of ore particles at the contact surfaces resulting in agglomeration of the particles into coarse lumpy and porous structure. The hot sinter is then cooled and sized usually into particles of ¼"-2". The resulting product forms the blast furnace sinter.

Sinter Quality

A smooth and efficient operation of the blast furnace requires sinter with certain properties. Ideally, the sinter should have the following characteristics:

1) It must be strong enough to resist disintegration during handling so that the breakdown between the sinter plant and the blast furnace is minimized.

2) It must also be strong enough to withstand the abrasive and compressive forces that it faces during the descent through the blast furnace.

3) A close size range with minimum amount of fines (−5 mm) is required in order to have a good burden permeability for better gas-to-solid contact.

4) Furthermore, the sinter must be sufficiently reducible to ensure that it does not pass down to the bosh zone virtually unchanged, since this would lead to a large percentage of reduction by solid carbon, i.e. an endothermic reaction, increasing the coke consumption.

5) Good low-temperature breakdown properties in the upper stack region of the furnace ensure an efficient operation of the furnace.

6) A high initial softening temperature with complete softening occurring over a narrow temperature range is required so that bosh hanging is minimized.

Testing of Sinter in Relevance to Iron Making Practice

Sinter quality specifications have been developed through a number of laboratory tests by several standards organizations and in some user industries themselves.

In assessing the properties of a burden material, one must consider all the properties of that particular material, the proportion of the material in the burden, the overall properties of other burden constituents, the relevant furnace practice and the financial implications.

Laboratory tests developed by some of the organizations show that the results can be correlated to furnace performance, although for some parameters, precise quantitative relationships are not yet available.

These laboratory tests that were developed by the International Standards Organization (ISO) and are essentially in line with the current trends, can be classified as follows:

1) handling properties (tumbler test)
2) reducibility
3) porosity
4) behaviour in the upper stack of the blast furnace (low-temperature disintegration test)
5) behaviour in the lower stack of the blast furnace (softening and melt down tests)

C—Use of Synthetic Olivine (or FRITMAG) as Source of MgO in a Blast Furnace Sinter As explained hereinabove, the invention is based on the discovery that the use of synthetic olivine, either in the form of granular synthetic olivine or in the form of FRITMAG, as a source of MgO in the production of iron ore sinter, has numerous and unexpected advantages, as compared to the use of dolomite or natural olivine.

More particularly, the invention is based on the discovery that the use of synthetic olivine as source of MgO leads to the production of an iron ore sinter which has the following advantages, as compared to sinter obtained with natural olivine or dolomite:

better impact resistance (tumbler strength)
better abrasion resistance
higher reducibility and
more "consistent" chemistry because the synthetic production of olivine allows proper adjustment of the chemical constituents of the resulting product by blending of the serpentinite material used as starting material with other raw material(s) whenever necessary.

The synthetic olivine is preferably added as a fine powder in the raw sinter mix. The size of the powder particles is not critical, although higher surface area facilitates the formation of micropellets.

The amount of synthetic olivine is preferably selected so that the obtained sinter comprises from 1 to 5% by weight of MgO, preferably 2%. The respective amounts of the other constituents may be selected as is known in the art. All these amounts should be balanced properly so that the basicity ratio $CaO+MgO/SiO_2+Al_2O_3$ of the sinter be ranging between 1.5 and 2.6.

D—Comparative Example

In this example, use was made of a raw sinter mix comprising iron-bearing materials including steel plants reverts, basic fluxes and a carbonaceous fuel. The basic composition of this mix is given in the following Table II.

TABLE II

| | wt. % |
|---|---|
| Specularite | 24.5 |
| Pellet fines | 13.7 |
| Mill scale | 8.8 |
| Iron fines | 7.6 |
| Return fines | 30.0 |
| FRITMAG | 1.5 |
| Limestone | 8.9 |
| Flue dust (fuel) | 5.0 |

Sinters were prepared from this raw mix, after addition thereto of different sources of MgO, namely FRITMAG
natural olivine
dolomite Each sinter mixture that was so prepared was mixed/micropelletized for 3 minutes using a disk and then charged into a sinter pot. The sintering was performed as is done industrially. During the preparation of all the samples, the bed height, suction etc. were kept constant. After the sintering was complete, each sinter cake was cooled to a suitable temperature and subjected to a shatter test by dropping it from a height of 6'. Subsequently, the sinter lumps were crushed to −2" and screened to various size fractions for testing. The results of the various tests are given in Table III.

TABLE III

Comparison of test data obtained with various MgO-bearing sources at basicity of 2.0, and MgO level of 3.0%

| Source of MgO | Tumbler strength 'T' index (%, +6.3 mm) | Tumbler strength 'A' index (%, −0.59 mm) | Reducibility dr (% − min$^{-1}$) $dt_{40}$ | RDI (+3.15 mm) |
|---|---|---|---|---|
| Fritmag | 65.2 | 5.2 | 1.33 | 83.0 |
| Natural olivine | 62.5 | 6.4 | 1.25 | 85.2 |
| Dolomite | 52.2 | 6.9 | 1.20 | 84.8 |

The outline of the test procedures and indications of the results obtained are described below.

Tumbler Test

This was conducted on a sinter sample of 25 lbs in the ⅜" to −2" fractions in a ASTM tumbler drum at 25 rpm for 8 minutes (i.e. 200 revolutions) and subsequently screened to determine the tumbler as 'T' index (+6.35 mm) and abrasion or 'A' index (−0.59 mm).

The 'T' index (+6.35 mm or +¼") reflects the impact resistance of the sinter during handling. The higher is the value, the better is the strength.

The 'A' index (−0.589 mm) expresses the resistance of sinter due to abrasion during handling. A lower value of the 'A' index indicates better resistance to abrasion.

The data presented in Table III clearly indicate that the impact resistance obtained with FRITMAG is better than with natural olivine and much better than with dolomite. The data also indicate that the resistance to abrasion with FRITMAG is much better than with natural olivine or dolomite.

Reducibility

The reducibility was determined using ISO test procedure. This test is carried out at an elevated temperature under a reducing gas atmosphere simulating blast furnace reduction conditions.

The gas reducibility of the burden, i.e. the ease with which oxygen can be removed from the iron-bearing materials in the blast furnace stack, by means of the ascending gases is an important parameter affecting the efficiency of the ironmaking process as reflected by the coke rate and the rate at which iron can be produced. A highly reducible burden implies a faster driving and a shorter residence time in the stack and high productivity of the blast furnace.

A high reducibility of sinter, therefore, reflects good reduction properties of the sinter.

The data reported in Table III show that the sinters produced with FRITMAG are more easily reducible as compared to those produced with natural olivine or dolomite.

Low-Temperature Reduction Strength (RDI)

The low-temperature reduction strength (RDI) of the sinters was determined by the ISO test procedure of static reduction followed by tumbling. This test simulates the blast furnace conditions in the upper stack regions where it is mildly reducing and temperatures are relatively low. A high +3.15 mm fraction following the tumbling is considered good (+3.15 mm≧80%).

The RDI reflects the resistance to degradation of the sinter in the upper stack of the blast furnace under mildly reducing conditions at low temperatures.

Following the tests, if the +3.15 mm fraction is high (≧80%), the sinter is considered to have met the low-temperature reduction strength requirement specified by most sinter plants.

The data reported in Table III shows that all the sinters that were produced meet the RDI requirement.

E—Advantages of Synthetic Olivine Over Natural Olivine and/or Dolomite as Source of MgO

Sinter Strength

Better tumbler strength (high value)

Better abrasion resistance (low value)

Possible reasons: Because of finer size material, the MgO gets more uniformly distributed in the mix and consequently in the sinter matrix. This probably has made the sinter structure more stable.

Reducibility

Better reducibility

Possible reasons: Right mineralogical assemblage - sinters have more acicular calcium ferrites with uniform distribution of pores, making the reduction gas easily accessible to the iron oxides for removal of oxygen.

As a MgO Source

Higher surface area (finer-sized material) helping in the formation of micropellets.

Consistent chemistry; since the material is synthetically produced, the % of chemical constituents can be maintained through proper blending with other raw materials.

We claim:

1. In an iron ore sinter for use in a blast furnace, said sinter being made from a raw sinter mix comprising:
   - iron-bearing materials;
   - basic fluxes including a source of CaO and a source of MgO; and
   - solid carbon-bearing material used as a heat-generating combustible, said raw sinter mix being subjected to:
   - a sintering treatment at a high temperature in order to cause said iron-bearing materials, fluxes and carbon-bearing material to agglomerate and sinter by incipient fusion;
   - an air-cooling treatment in order to produce a hard lumpy substance having a porous cellular structure; and
   - a mechanical treatment to break the lumpy substance into sinters of a given size, the improvement wherein the source of MgO in the raw sinter mix consists of synthetic olivine, exclusively.

2. An iron ore sinter according to claim 1, wherein said iron-ore sinter has the following chemical composition:

| | |
|---|---|
| Fe | from 48 to 60% |
| CaO | from 7 to 15% |
| $SiO_2$ | from 3 to 8% |

-continued

| | |
|---|---|
| MgO | from 1 to 5% |
| $Al_2O_3$ | from 0.3 to 3% |

wherein said percentage amounts are by weight and the balance of said sinter consists of FeO, Mn, S and moisture, and wherein the basicity ratio of the composition of said sinter, defined as:

$$\frac{CaO + MgO}{SiO_2 + Al_2O_3}$$

ranges from 1.5 to 2.6.

3. An iron ore sinter according to claim 2, wherein the iron-bearing materials comprise up to 50% by weight of fine iron ore concentrates.

4. An iron ore sinter according to claim 2, wherein the source of CaO is limestone.

5. An iron ore sinter according to claim 2, wherein the solid carbon-bearing material is selected from the group consisting of coke breeze, petroleum coke and coal.

6. An iron ore sinter according to claim 2, wherein the iron-bearing materials comprise up to 50% by weight of fine iron ore concentrates;

the source of CaO is limestone; and the solid carbon-bearing material is selected from the group consisting of coke breeze, petroleum coke and coal.

7. An iron ore sinter according to claim 1, wherein said synthetic olivine is a fibrous-like synthetic forsterite obtained by calcination of chrysotile asbestos fibres at a temperature ranging from 650° C. to 1,450° C., said synthetic forsterite having an $MgO:SiO_2$ ratio lower than 1:1, raw loose density ranging from 3 to 40 pcf, a thermal conductivity "k" factor ranging from 0.25 to 0.40 BTU, in/hr. °F.ft$^2$ and a fusion point ranging from 1,600° to 1,700° C.

8. An iron ore sinter according to claim 2, wherein said synthetic olivine is a fibrous-like synthetic forsterite obtained by calcination of chrysotile asbestos fibres at a temperature ranging from 650° to 1,450° C., said synthetic forsterite having an $MgO:SiO_2$ ratio lower than 1:1, a raw loose density ranging from 3 to 40 pcf, a thermal conductivity "k" factor ranging from 0.25 to 0.40 BTU, in/hr. °F.ft$^2$ and a fusion point ranging from 1,600° to 1,700° C.

9. An iron ore sinter according to claim 3, wherein said synthetic olivine is a fibrous-like synthetic forsterite obtained by calcination of chrysotile asbestos fibres at a temperature ranging from 650° C. to 1,450° C., said synthetic forsterite having an $MgO:SiO_2$ ratio lower than 1:1, a raw loose density ranging from 3 to 40 pcf, a thermal conductivity "k" factor ranging from 0.25 to 0.40 BTU, in/hr. °F.ft$^2$ and a fusion point ranging from 1,600° to 1,700° C.

10. An iron ore sinter according to claim 4, wherein said synthetic olivine is a fibrous-like synthetic forsterite obtained by calcination of chrysotile asbestos fibres at a temperature ranging from 650° C. to 1,450° C., said synthetic forsterite having an $MgO:SiO_2$ ratio lower than 1:1, a raw loose density ranging from 3 to 40 pcf, a thermal conductivity "k" factor ranging from 0.25 to 0.40 BTU, in/hr. °F.ft$^2$ and a fusion point ranging from 1,600° to 1,700° C.

11. An iron ore sinter according to claim 5, wherein said synthetic olivine is a fibrous-like synthetic forsterite obtained by calcination of chrysotile asbestos fibres at a temperature ranging from 650° C. to 1,450° C., said synthetic forsterite having an $MgO:SiO_2$ ratio lower than 1:1, a raw loose density ranging from 3 to 40 pcf, a thermal conductivity "k" factor ranging from 0.25 to 0.40 BTU, in/hr. °F.ft$^2$ and a fusion point ranging from 1,600° to 1,700° C.

12. An iron ore sinter according to claim 6, wherein said synthetic olivine is a fibrous-like synthetic forsterite obtained by calcination of chrysotile asbestos fibres at a temperature ranging from 650° C. to 1,450° C., said synthetic forsterite having an $MgO:SiO_2$ ratio lower than 1:1, a raw loose density ranging from 3 to 40 pcf, a thermal conductivity "k" factor ranging from 0.25 to 0.40 BTU, in/hr. °F.ft$^2$ and a fusion point ranging from 1,600° to 1,700° C.

* * * * *